US007047908B2

(12) United States Patent
Henderson

(10) Patent No.: US 7,047,908 B2
(45) Date of Patent: May 23, 2006

(54) COOLING FLANGE

(75) Inventor: Raymond N. Henderson, Federal Way, WA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/733,510

(22) Filed: Dec. 11, 2003

(65) Prior Publication Data

US 2005/0126511 A1 Jun. 16, 2005

(51) Int. Cl.
*F23J 3/02* (2006.01)

(52) U.S. Cl. ..... 122/395; 137/340; 165/95

(58) Field of Classification Search ..... 122/395, 122/379, 390; 165/95; 285/123.15, 123.16, 285/13, 14; 137/338, 340; 277/609, 616, 277/614, 625, 431, 500; 418/104
See application file for complete search history.

(56) References Cited

U.S. PATENT DOCUMENTS

| | | | | | |
|---|---|---|---|---|---|
| 2,949,282 | A * | 8/1960 | Kirkby | 165/95 |
| 3,216,046 | A | 11/1965 | Chappell | |
| 3,747,963 | A * | 7/1973 | Shivak | 285/336 |
| 4,359,800 | A | 11/1982 | Ziels | |
| 4,545,329 | A * | 10/1985 | Adams | 122/17.2 |
| 4,765,394 | A | 8/1988 | Ziegler | |
| 4,767,138 | A * | 8/1988 | Schafbuch | 285/368 |
| 4,813,688 | A * | 3/1989 | Heilala | 277/370 |
| 4,905,900 | A * | 3/1990 | Scharton et al. | 239/99 |
| 5,237,718 | A * | 8/1993 | Brown | 15/318.1 |
| 5,401,062 | A * | 3/1995 | Vowles | 285/12 |
| 5,494,004 | A * | 2/1996 | Hunter, Jr. | 122/395 |
| 5,558,341 | A * | 9/1996 | McNickle et al. | 277/400 |
| 5,709,544 | A * | 1/1998 | Wurtz | 432/242 |
| 6,202,981 | B1 * | 3/2001 | Davis et al. | 251/143 |
| 6,438,191 | B1 | 8/2002 | Bickes, Jr. et al. | |
| 6,513,982 | B1 * | 2/2003 | Boyd et al. | 384/475 |
| 6,684,823 | B1 | 2/2004 | Plavnik et al. | |
| 6,712,403 | B1 * | 3/2004 | Dusevic | 285/368 |
| 2002/0112638 | A1 | 8/2002 | Zilka et al. | |

FOREIGN PATENT DOCUMENTS

| | | |
|---|---|---|
| GB | 1013049 | 12/1965 |
| GB | 1121378 | 7/1968 |
| GB | 1160439 | 8/1969 |
| YU | P 1756/88 | 6/1990 |
| YU | P 1728/88 | 2/1992 |

OTHER PUBLICATIONS

Hanjalic et al., "Detonation-Wave Technique for On-Load Deposit . . . ", Journal of Engineering for Gas Turbines and Power, Jan., 1994, pp. 223-236, vol. 116.

(Continued)

*Primary Examiner*—Gregory Wilson
(74) *Attorney, Agent, or Firm*—Bachman & LaPointe, P.C.

(57) ABSTRACT

An apparatus has a body with first and second faces, an inboard surface bounding a central aperture, an outboard perimeter, and an array of bolt holes between the first and second faces. A channel is inboard of the bolt holes and first and second ports communicate with the channel. The apparatus may be used as a cooling flange in a detonative cleaning apparatus.

27 Claims, 10 Drawing Sheets

OTHER PUBLICATIONS

Huque, "Experimental Investigation of Slag Removal Using . . . ", Annual Symposium, Mar. 16-18, 1999, pp. 1-6, Miami, FL.

Hanjalic et al., "Further Experience in Using Detonation Waves . . . ", International Journal of Energy Research, Apr. 7, 1993, pp. 583-595, vol. 17.

* cited by examiner

COOLING FLANGE

BACKGROUND OF THE INVENTION (1) Field of the Invention

The invention relates to industrial equipment. More particularly, the invention relates to the detonative cleaning of industrial equipment.

(2) Description of the Related Art

Surface fouling is a major problem in industrial equipment. Such equipment includes furnaces (coal, oil, waste, etc.), boilers, gasifiers, reactors, heat exchangers, and the like. Typically the equipment involves a vessel containing internal heat transfer surfaces that are subjected to fouling by accumulating particulate such as soot, ash, minerals and other products and byproducts of combustion, more integrated buildup such as slag and/or fouling, and the like. Such particulate build-up may progressively interfere with plant operation, reducing efficiency and throughput and potentially causing damage. Cleaning of the equipment is therefore highly desirable and is attended by a number of relevant considerations. Often direct access to the fouled surfaces is difficult. Additionally, to maintain revenue it is desirable to minimize industrial equipment downtime and related costs associated with cleaning. A variety of technologies have been proposed. By way of example, various technologies have been proposed in U.S. Pat. Nos. 5,494,004 and 6,438,191 and U.S. patent application publication 2002/0112638. Additional technology is disclosed in Huque, Z. Experimental Investigation of Slag Removal Using Pulse Detonation Wave Technique, DOE/HBCU/OMI Annual Symposium, Miami, Fla., Mar. 16–18, 1999. Particular blast wave techniques are described by Hanjalić and Smajević in their publications: Hanjalić, K. and Smajević, I., Further Experience Using Detonation Waves for Cleaning Boiler Heating Surfaces, International Journal of Energy Research Vol. 17, 583–595 (1993) and Hanjalić, K. and Smajević, I., Detonation-Wave Technique for On-load Deposit Removal from Surfaces Exposed to Fouling: Parts I and II, Journal of Engineering for Gas Turbines and Power, Transactions of the ASME, Vol. 1, 116 223–236, January 1994. Such systems are also discussed in Yugoslav patent publications P 1756/88 and P 1728/88. Such systems are often identified as "soot blowers" after an exemplary application for the technology.

Nevertheless, there remain opportunities for further improvement in the field.

SUMMARY OF THE INVENTION

One aspect of the invention involves an apparatus having a body with first and second faces. The body has an inboard surface bounding a central aperture and an outboard perimeter. An array of bolt holes extend between the first and second faces. A channel is inboard of the bolt holes. First and second ports are in communication with the channel.

In various implementations, the channel may be in the first face. A sealing ring may reside in an outboard portion of the channel. First and second ports may be formed in the perimeter. The body may be a unitary metal member. The channel may be a full annulus. A divider member may be positioned in the channel between the first and second ports. The channel may have a full annulus outboard portion and a partial annulus second portion of at least 300° of arc. There may be at least eight such bolt holes.

The apparatus may be combined with a flow of liquid through the channel and entering the flange through the first port and exiting the flange through the second port. The apparatus may be combined with a mating flange having a first face in facing relation to the first face of the body and a number of bolts. Each of the bolts may extend through an associated one of the bolt holes. The apparatus may be combined with a furnace having a furnace wall separating a furnace exterior from a furnace interior and having a wall aperture. That combination may include a soot blower outlet assembly positioned to direct a soot blower gas flow through the wall aperture, a soot blower gas source, and one or more soot blower gas conduit portions along a soot blower gas flowpath between the soot blower gas source and the soot blower outlet assembly. The apparatus may also be positioned along the soot blower gas flowpath. The soot blower outlet assembly may extend at least partially through the furnace wall.

Another aspect of the invention involves a method for operating a detonative cleaning apparatus for cleaning a surface within a vessel. In a repeated manner, a conduit is charged and the charge is detonated. The detonation results in the direction of a shockwave from an outlet portion of the conduit to impact the surface. A portion of the conduit upstream of the outlet portion is locally cooled.

In various implementations, the cooling may be provided via a cooling fluid. The cooling may be provided no less than 0.1 m upstream of an outlet end of the conduit and no less than 2 m downstream of an upstream end of the conduit. The cooling fluid may have an essentially constant flow between discharges of the apparatus. The cooling fluid may flow along a flowpath nonintersecting with a conduit discharge flowpath.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
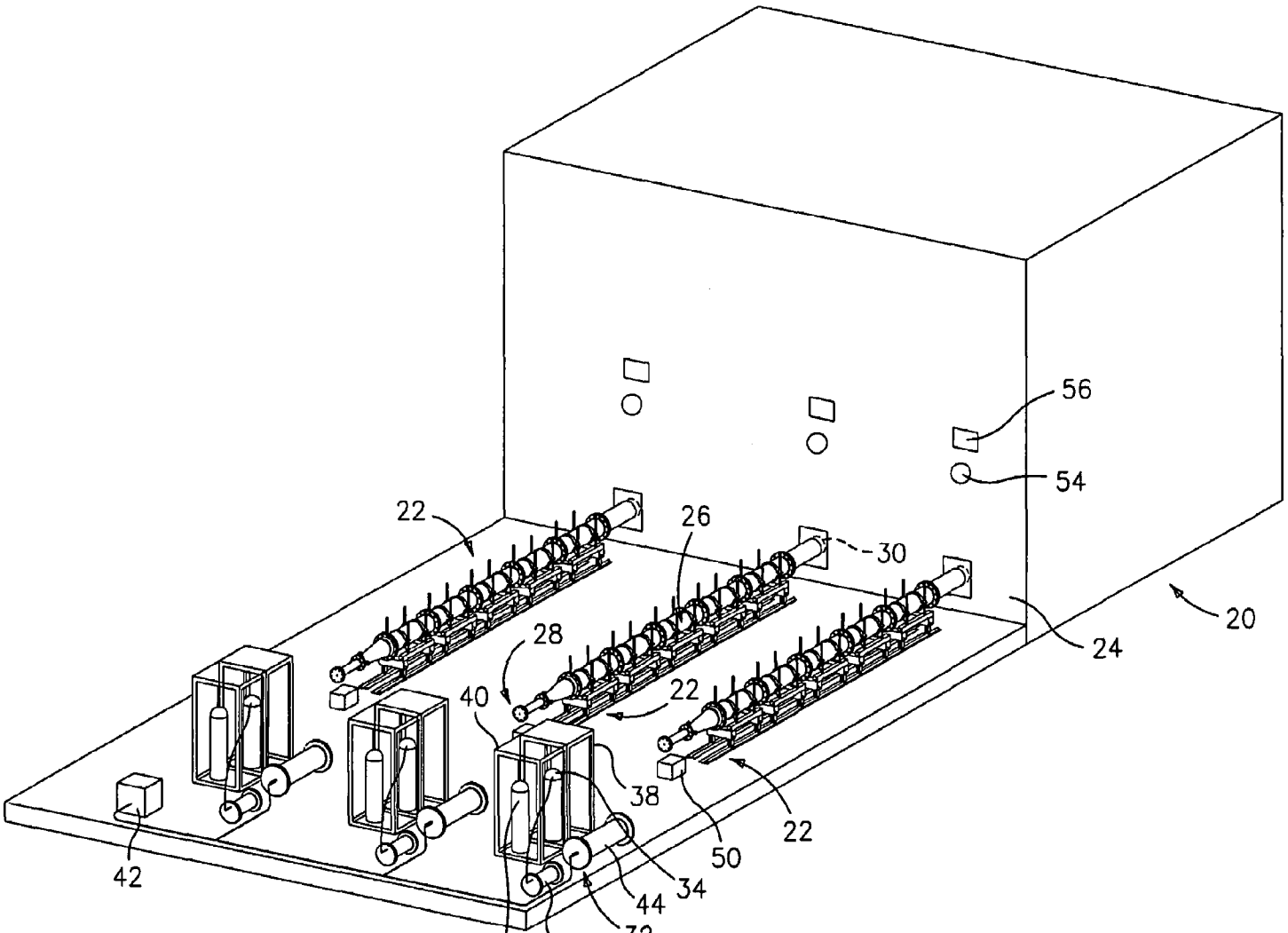
FIG. 1 is a view of an industrial furnace associated with several soot blowers positioned to clean a level of the furnace.

FIG. 1 shows a furnace 20 having an exemplary three associated soot blowers 22. In the illustrated embodiment, the furnace vessel is formed as a right parallelepiped and the soot blowers are all associated with a single common wall 24 of the vessel and are positioned at like height along the wall. Other configurations are possible (e.g., a single soot blower, one or more soot blowers on each of multiple levels, and the like).

Each soot blower 22 includes an elongate combustion conduit 26 extending from an upstream distal end 28 away from the furnace wall 24 to a downstream proximal end 30 closely associated with the wall 24. Optionally, however, the end 30 may be well within the furnace. In operation of each soot blower, combustion of a fuel/oxidizer mixture within the conduit 26 is initiated proximate the upstream end (e.g., within an upstreammost 10% of a conduit length) to produce a detonation wave which is expelled from the downstream end as a shockwave along with associated combustion gases for cleaning surfaces within the interior volume of the furnace. Each soot blower may be associated with a fuel/oxidizer source 32. Such source or one or more components thereof may be shared amongst the various soot blowers. An exemplary source includes a liquified or compressed gaseous fuel cylinder 34 and an oxygen cylinder 36 in respective containment structures 38 and 40. In the exemplary embodiment, the oxidizer is a first oxidizer such as essentially pure oxygen. A second oxidizer may be in the form of shop air delivered from a central air source 42. In the exemplary embodiment, air is stored in an air accumulator 44. Fuel, expanded from that in the cylinder 34 is generally stored in a fuel accumulator 46. Each exemplary source 32 is coupled to the associated conduit 26 by appropriate plumbing below. Similarly, each soot blower includes a spark box 50 for initiating combustion of the fuel oxidizer mixture and which, along with the source 32, is controlled by a control and monitoring system (not shown). FIG. 1 further shows the wall 24 as including a number of ports for inspection and/or measurement. Exemplary ports include an optical monitoring port 54 and a temperature monitoring port 56 associated with each soot blower 22 for respectively receiving an infrared and/or visible light video camera and thermocouple probe for viewing the surfaces to be cleaned and monitoring internal temperatures. Other probes/monitoring/sampling may be utilized, including pressure monitoring, composition sampling, and the like.

Figure 2:
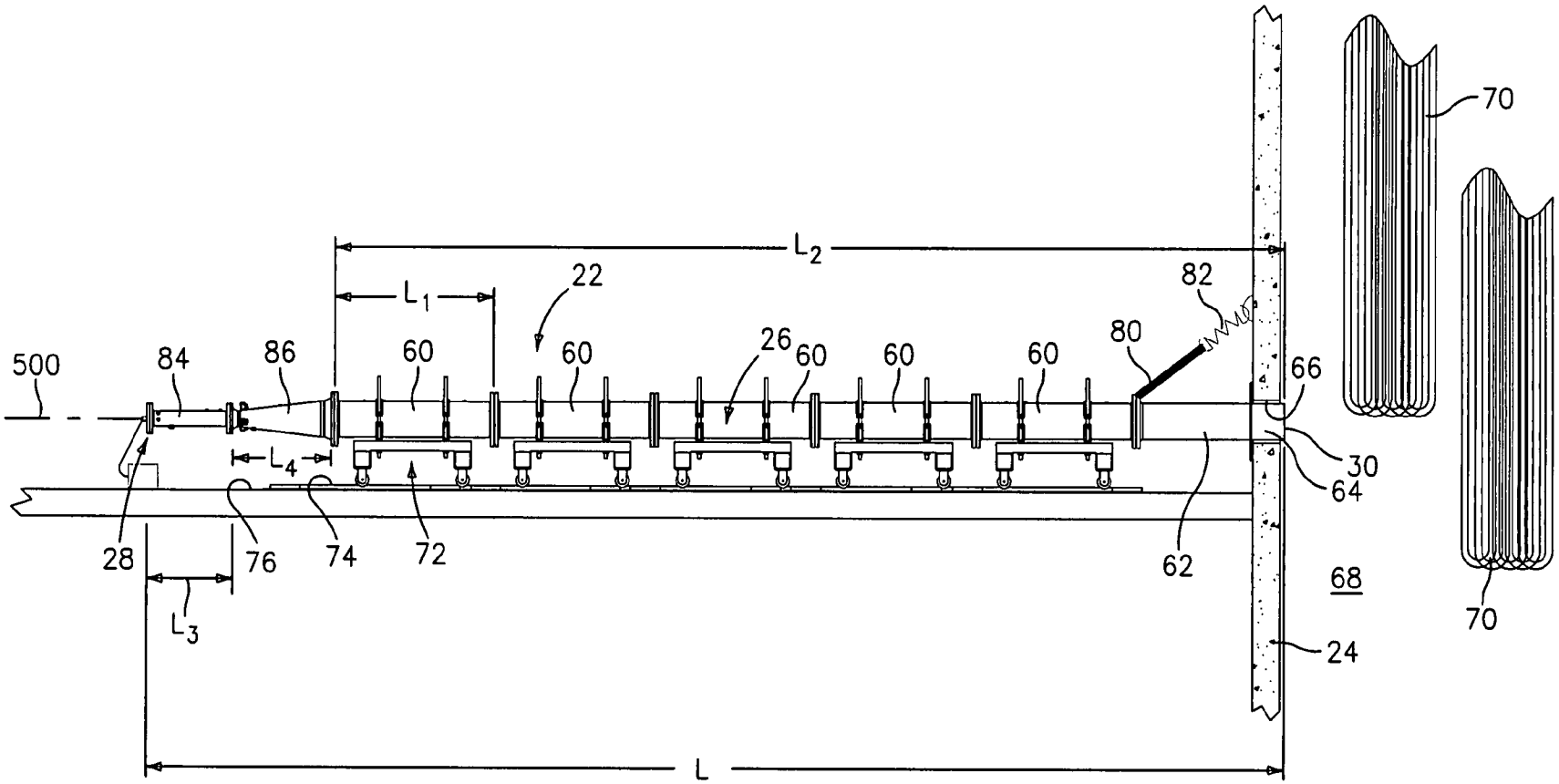
FIG. 2 is a side view of one of the blowers of FIG. 1.

FIG. 2 shows further details of an exemplary soot blower 22. The exemplary detonation conduit 26 is formed with a main body portion formed by a series of doubly flanged conduit sections or segments 60 arrayed from upstream to downstream and a downstream nozzle conduit section or segment 62 having a downstream portion 64 extending through an aperture 66 in the wall and ending in the downstream end or outlet 30 exposed to the furnace interior 68. The term nozzle is used broadly and does not require the presence of any aerodynamic contraction, expansion, or combination thereof. Exemplary conduit segment material is metallic (e.g., stainless steel). The outlet 30 may be located further within the furnace if appropriate support and cooling are provided. FIG. 2 further shows furnace interior tube bundles 70, the exterior surfaces of which are subject to fouling. In the exemplary embodiment, each of the conduit segments 60 is supported on an associated trolley 72, the wheels of which engage a track system 74 along the facility floor 76. The exemplary track system includes a pair of parallel rails engaging concave peripheral surfaces of the trolley wheels. The exemplary segments 60 are of similar length $L_1$ and are bolted end-to-end by associated arrays of bolts in the bolt holes of their respective flanges. Similarly, the downstream flange of the downstreammost of the segments 60 is bolted to the upstream flange of the nozzle 62. In the exemplary embodiment, a reaction strap 80 (e.g., cotton or thermally/structurally robust synthetic) in series with one or more metal coil reaction springs 82 is coupled to this last mated flange pair and connects the combustion conduit to an environmental structure such as the furnace wall for resiliently absorbing reaction forces associated with discharging of the soot blower and ensuring correct placement of the combustion conduit for subsequent firings. Optionally, additional damping (not shown) may be provided. The reaction strap/spring combination may be formed as a single length or a loop. In the exemplary embodiment, this combined downstream section has an overall length $L_2$. Alternative resilient recoil absorbing means may include non-metal or non-coil springs or rubber or other elastomeric elements advantageously at least partially elastically deformed in tension, compression, and/or shear, pneumatic recoil absorbers, and the like.

Extending downstream from the upstream end 28 is a predetonator conduit section/segment 84 which also may be doubly flanged and has a length $L_3$. The predetonator conduit segment 84 has a characteristic internal cross-sectional area (transverse to an axis/centerline 500 of the conduit) which is smaller than a characteristic internal cross-sectional area (e.g., mean, median, mode, or the like) of the downstream portion (60, 62) of the combustion conduit. In an exemplary embodiment involving circular sectioned conduit segments, the predetonator cross-sectional area is a characterized by a diameter of between 8 cm and 12 cm whereas the downstream portion is characterized by a diameter of between 20 cm and 40 cm. Accordingly, exemplary cross-sectional area ratios of the downstream portion to the predetonator segment are between 1:1 and 10:1, more narrowly, 2:1 and 10:1. An overall length L between ends 28 and 30 may be 1–15 m, more narrowly, 5–15 m. In the exemplary embodiment, a transition conduit segment 86 extends between the predetonator segment 84 and the upstreammost segment 60. The segment 86 has upstream and downstream flanges sized to mate with the respective flanges of the segments 84 and 60 has an interior surface which provides a smooth transition between the internal cross-sections thereof. The exemplary segment 86 has a length $L_4$. An exemplary half angle of divergence of the interior surface of segment 86 is $\leqq 12°$, more narrowly 5–10°.

Figure 3:
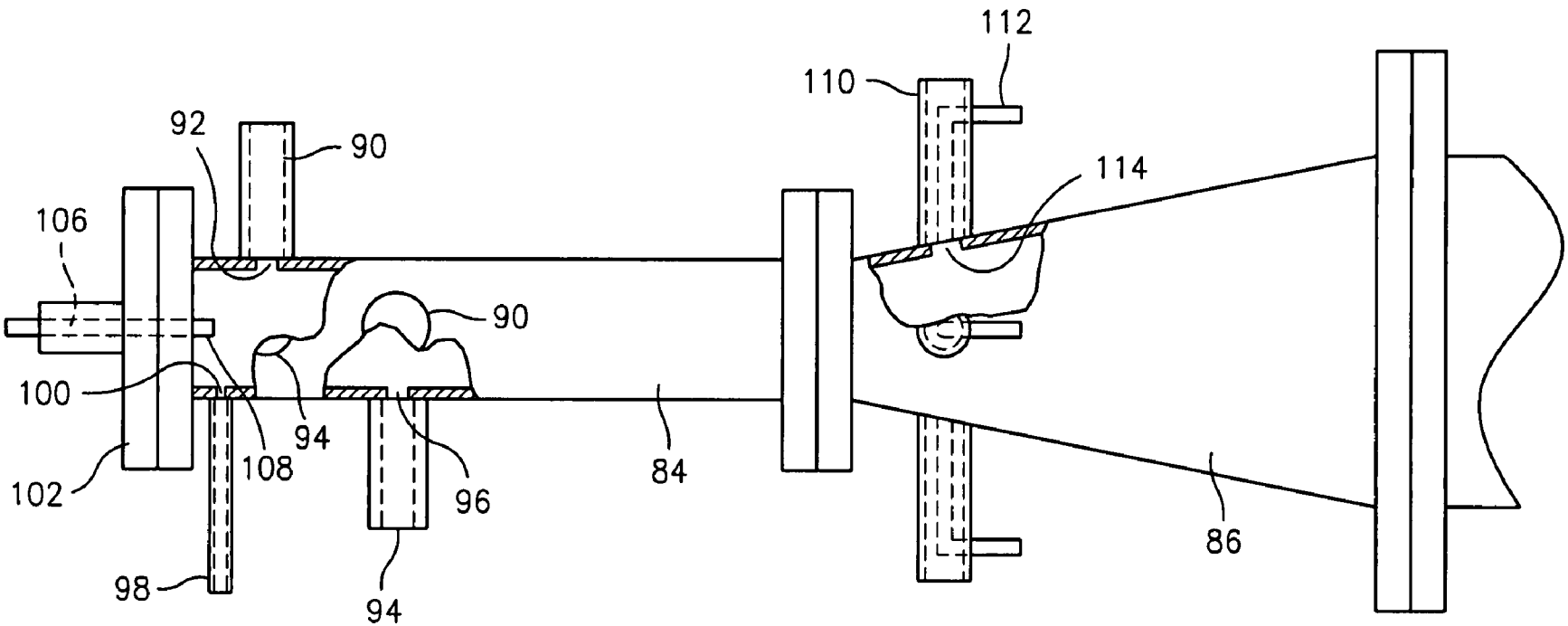
FIG. 3 is a partially cut-away side view of an upstream end of the blower of FIG. 2.

A fuel/oxidizer charge may be introduced to the detonation conduit interior in a variety of ways. There may be one or more distinct fuel/oxidizer mixtures. Such mixture(s) may be premixed external to the detonation conduit, or may be mixed at or subsequent to introduction to the conduit. FIG. 3 shows the segments 84 and 86 configured for distinct introduction of two distinct fuel/oxidizer combinations: a predetonator combination; and a main combination. In the exemplary embodiment, in an upstream portion of the segment 84, a pair of predetonator fuel injection conduits 90 are coupled to ports 92 in the segment wall which define fuel injection ports. Similarly, a pair of predetonator oxidizer conduits 94 are coupled to oxidizer inlet ports 96. In the exemplary embodiment, these ports are in the upstream half of the length of the segment 84. In the exemplary embodiment, each of the fuel injection ports 92 is paired with an associated one of the oxidizer ports 96 at even axial position and at an angle (exemplary 90° shown, although other angles including 180° are possible) to provide opposed jet mixing of fuel and oxidizer. Discussed further below, a purge gas conduit 98 is similarly connected to a purge gas port 100 yet further upstream. An end plate 102 bolted to the upstream flange of the segment 84 seals the upstream end of the combustion conduit and passes through an igniter/initiator 106 (e.g., a spark plug) having an operative end 108 in the interior of the segment 84.

In the exemplary embodiment, the main fuel and oxidizer are introduced to the segment 86. In the illustrated embodiment, main fuel is carried by a number of main fuel conduits 112 and main oxidizer is carried by a number of main oxidizer conduits 110, each of which has terminal portions concentrically surrounding an associated one of the fuel conduits 112 so as to mix the main fuel and oxidizer at an associated inlet 114. In exemplary embodiments, the fuels are hydrocarbons. In particular exemplary embodiments, both fuels are the same, drawn from a single fuel source but mixed with distinct oxidizers: essentially pure oxygen for the predetonator mixture; and air for the main mixture. Exemplary fuels useful in such a situation are propane, MAPP gas, or mixtures thereof. Other fuels are possible, including ethylene and liquid fuels (e.g., diesel, kerosene, and jet aviation fuels). The oxidizers can include mixtures such as air/oxygen mixtures of appropriate ratios to achieve desired main and/or predetonator charge chemistries. Further, monopropellant fuels having molecularly combined fuel and oxidizer components may be options.

In operation, at the beginning of a use cycle, the combustion conduit is initially empty except for the presence of air (or other purge gas). The predetonator fuel and oxidizer are then introduced through the associated ports filling the segment 84 and extending partially into the segment 86 (e.g., to near the midpoint) and advantageously just beyond the main fuel/oxidizer ports. The predetonator fuel and oxidizer flows are then shut off. An exemplary volume filled the predetonator fuel and oxidizer is 1–40%, more narrowly 1–20%, of the combustion conduit volume. The main fuel and oxidizer are then introduced, to substantially fill some fraction (e.g., 20–100%) of the remaining volume of the combustor conduit. The main fuel and oxidizer flows are then shut off. The prior introduction of predetonator fuel and oxidizer past the main fuel/oxidizer ports largely eliminates the risk of the formation of an air or other non-combustible slug between the predetonator and main charges. Such a slug could prevent migration of the combustion front between the two charges.

With the charges introduced, the spark box is triggered to provide a spark discharge of the initiator igniting the predetonator charge. The predetonator charge being selected for very fast combustion chemistry, the initial deflagration quickly transitions to a detonation within the segment 84 and producing a detonation wave. Once such a detonation wave occurs, it is effective to pass through the main charge which might, otherwise, have sufficiently slow chemistry to not detonate within the conduit of its own accord. The wave passes longitudinally downstream and emerges from the downstream end 30 as a shockwave within the furnace interior, impinging upon the surfaces to be cleaned and thermally and mechanically shocking to typically at least loosen the contamination. The wave will be followed by the expulsion of pressurized combustion products from the detonation conduit, the expelled products emerging as a jet from the downstream end 30 and further completing the cleaning process (e.g., removing the loosened material). After or overlapping such venting of combustion products, a purge gas (e.g., air from the same source providing the main oxidizer and/or nitrogen) is introduced through the purge port 100 to drive the final combustion products out and leave the detonation conduit filled with purge gas ready to repeat the cycle (either immediately or at a subsequent regular interval or at a subsequent irregular interval (which may be manually or automatically determined by the control and monitoring system)). Optionally, a baseline flow of the purge gas may be maintained between charge/discharge cycles so as to prevent gas and particulate from the furnace interior from infiltrating upstream and to assist in cooling of the detonation conduit.

Figure 4:
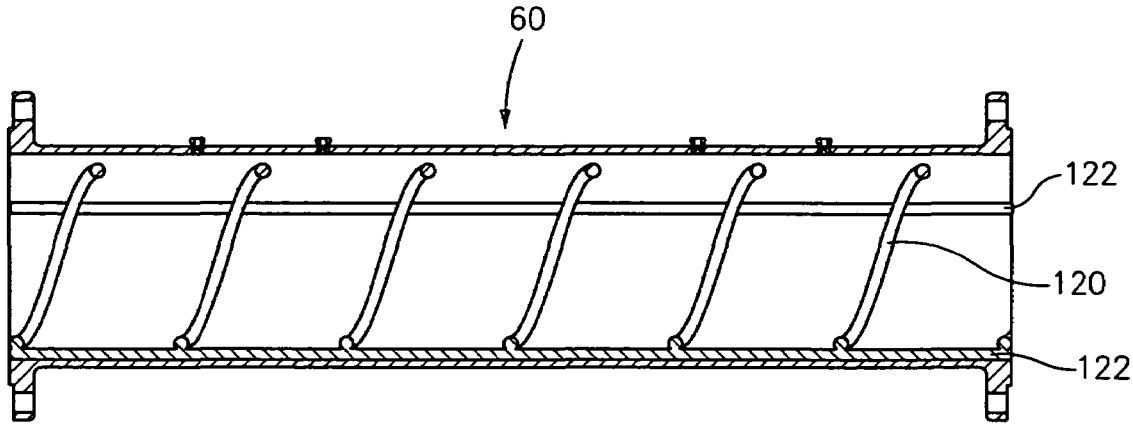
FIG. 4 is a longitudinal sectional view of a main combustor segment of the soot blower of FIG. 2.
Figure 5:
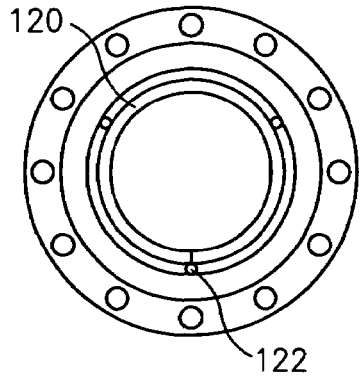
FIG. 5 is an end view of the segment of FIG. 4.

In various implementations, internal surface enhancements may substantially increase internal surface area beyond that provided by the nominally cylindrical and frustoconical segment interior surfaces. The enhancement may be effective to assist in the deflagration-to-detonation transition or in the maintenance of the detonation wave. FIG. 4 shows internal surface enhancements applied to the interior of one of the main segments 60. The exemplary enhancement is nominally a Chin spiral, although other enhancements such as Shchelkin spirals and Smirnov cavities may be utilized. The spiral is formed by a helical member 120. The exemplary member 120 is formed as a circular-sectioned metallic element (e.g., stainless steel wire) of approximately 8–20 mm in sectional diameter. Other sections may alternatively be used. The exemplary member 120 is held spaced-apart from the segment interior surface by a plurality of longitudinal elements 122. The exemplary longitudinal elements are rods of similar section and material to the member 120 and welded thereto and to the interior surface of the associated segment 60. Such enhancements may also be utilized to provide predetonation in lieu of or in addition to the foregoing techniques involving different charges and different combustor cross-sections.

The apparatus may be used in a wide variety of applications. By way of example, just within a typical coal-fired furnace, the apparatus may be applied to: the pendants or secondary superheaters, the convective pass (primary superheaters and the economizer bundles); air preheaters; selective catalyst removers (SCR) scrubbers; the baghouse or electrostatic precipitator; economizer hoppers; ash or other heat/accumulations whether on heat transfer surfaces or elsewhere, and the like. Similar possibilities exist within other applications including oil-fired furnaces, black liquor recovery boilers, biomass boilers, waste reclamation burners (trash burners), and the like.

Further steps may be taken to isolate the combustion conduit (or major portion thereof) from chemical contamination and thermal stresses.

Figure 6:
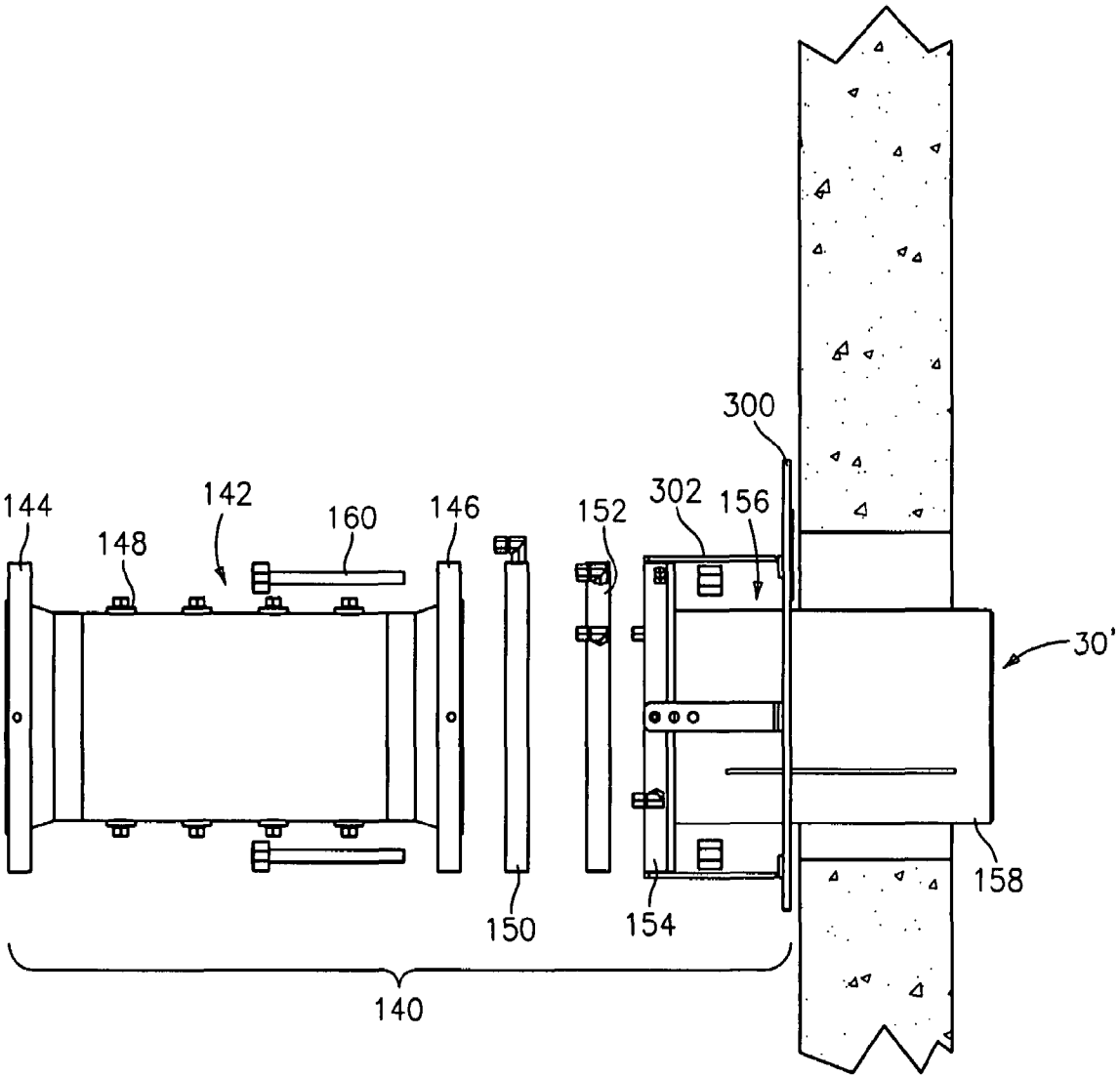
FIG. 6 is a side view of an alternate discharge end portion of a combustion tube assembly.

FIG. 6 shows an outlet/discharge end assembly 140 extending to an outlet 30'. The outlet end assembly 140 may be used as a downstream nozzle/outlet conduit section in place of the section 62 of FIG. 2. Although identified as a nozzle, this does not require the presence of any particular convergence, divergence, or combination thereof in the nozzle. The exemplary assembly 140 provides means for thermally and chemically isolating upstream portions of the combustion conduit. From upstream to downstream, the assembly 140 includes a doubly flanged conduit segment 142 having upstream and downstream bolting flanges 144 and 146. The body of the conduit segment 142 may have a number of instrumentation and/or sampling ports 148 which may be plugged to the extent not in use. The flange 144 has an upstream face for mounting to the downstream face of the downstream flange of the penultimate conduit segment. This junction may also serve for connection of the reaction strap or other means. The flange 146 has a downstream face for mating with the upstream face of an air curtain flange 150 which, as described below, provides chemical isolation for portions of the combustion conduit upstream thereof. The air curtain flange 150 has a downstream face for mating with the upstream face of a thermal isolation flange 152 which is cooled to isolate upstream portions of the combustion conduit from heating (thermal soakback) from the furnace. The thermal isolation flange 152 has a downstream face for mating with an upstream face of a flange 154 of a nozzle assembly 156 having a nozzle body 158 extending to the outlet 30' and further cooled as described below. Nut and bolt combinations 160 extend through the bolt holes of the flanges 146, 150, 152 and 154 to structurally and sealingly secure the assembly components together.

Figure 8:
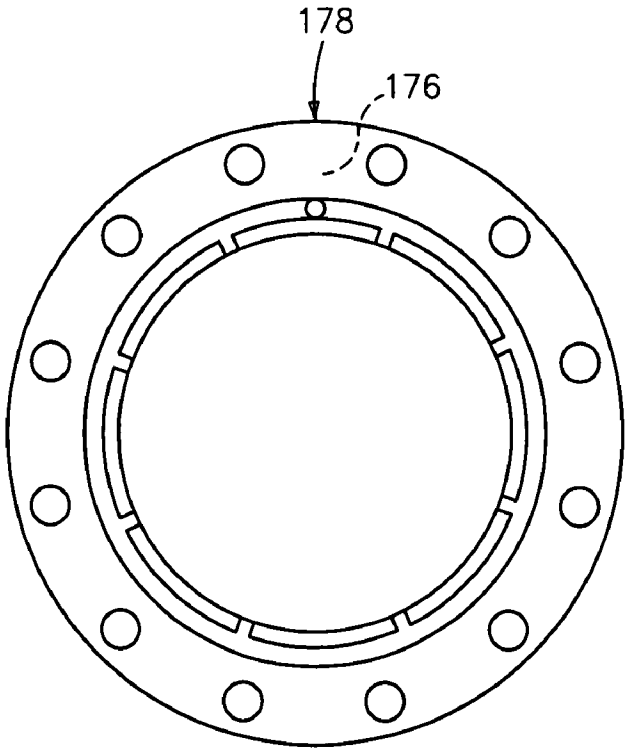
FIG. 8 is a downstream end view of the flange of FIG. 7.
Figure 7:
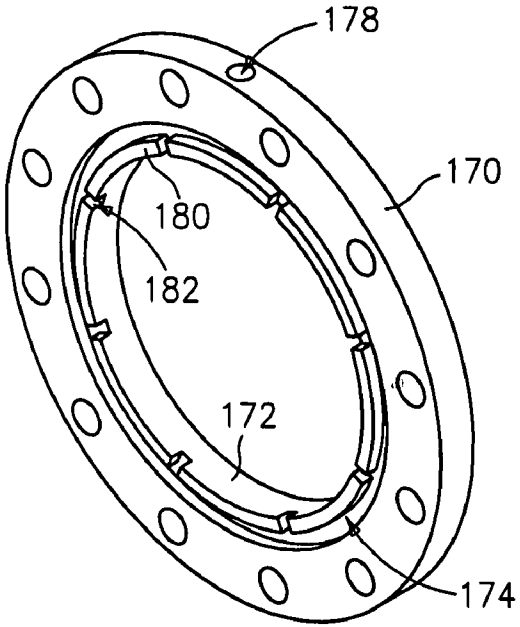
FIG. 7 is a view of an air curtain flange of the assembly of FIG. 6.

The exemplary air curtain flange 150 (FIGS. 7 and 8) includes the upstream and downstream faces, an exterior perimeter surface 170 and an interior surface 172 circumscribing the combustion gas flowpath. An array of bolt holes extend between the upstream and downstream faces. The interior surface 172 is at substantially even radius from the detonation conduit centerline as is the interior surface of the adjacent conduit segment 142. An annular channel 174 is formed in one of the faces (e.g., the downstream face) and is in communication via a connecting passageway 176 with an exterior port 178 on the perimeter surface. An interior rim 180 (shown as a portion of the downstream face separated from the remainder by the channel) of the channel along the interior surface is segmented or castellated by a circumferential array of slots 182. In the assembled condition, the mouth of the rim is closed by the adjacent face of its mating flange (e.g., the upstream face of the thermal isolation flange or the downstream face of downstream flange 146 of the conduit segment 142). Gas (e.g., air, $N_2$, $CO_2$, or other relatively inert gas) may be introduced to the channel 174 through the passageway and port (which may be provided with an appropriate connection fitting (not shown in FIGS. 7 and 8)). When so introduced, the gas fills the channel and flows inward into the combustion conduit interior through the slots. Exemplary air curtain flanges may be machined (e.g., directly or from a casting or forging) of appropriate metal (e.g., steel or nickel- or cobalt-based superalloy).

Figure 16:
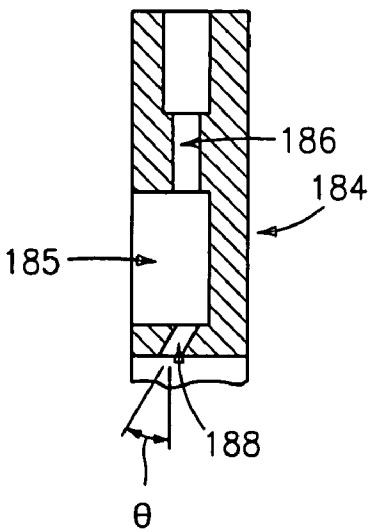
FIG. 16 is a partial longitudinal sectional view of an alternate air curtain flange.

FIG. 16 shows an alternate thermal isolation flange 184 including a channel 185 and passageway 186. The alternate flange 184 may be similarly constructed to the flange 150. The exemplary alternate flange 184 differs in that its outlets are provided by full holes 188 in the inboard/interior surface rather than by recesses. Furthermore, those holes are angled so that the discharge outflow is off-radial (e.g., by an angle $\theta$ so as to have a downstream longitudinal component). The hole centerlines may, also, be oriented with a tangential component if a tangential flow component is desired. The downstream longitudinal flow component may further assist in preventing contaminant from passing upstream from the furnace. Exemplary values for $\theta$ are between 5° and 60°.

In operation, the gas flow may supplement or replace a baseline continuous purge gas flow. The proximity of the air curtain flange 150 to the outlet 30' may provide improved resistance to the upstream reinfiltration of combustion gases discharged from the apparatus and infiltration of general furnace gases as well as particulate contamination. In addition to contamination from particulates generated within the furnace, the air curtain flow prevents accumulation of particulate reaction products from the combustion gases especially as such gases may cool and precipitate out particles or liquid condensate which may, in turn, accommodate particle formation or sludge formation. If operated in a baseline fashion, the continuous gas flow may also provide supplemental cooling of the conduit (especially downstream of the point of introduction).

Figure 10:
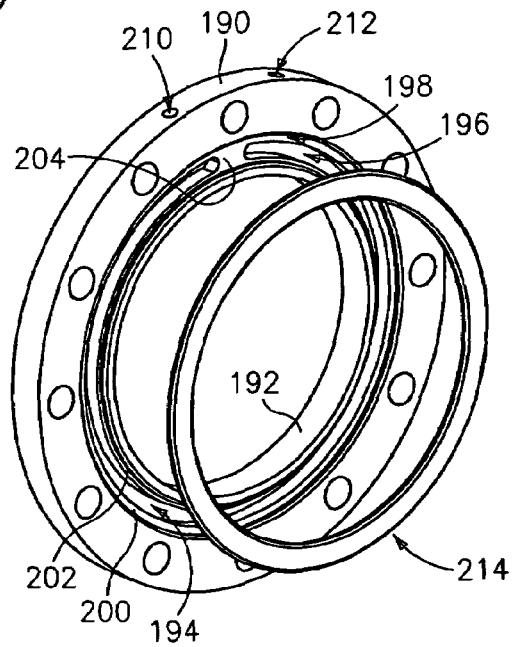
FIG. 10 is an exploded view of the assembly of FIG. 9.
Figure 9:
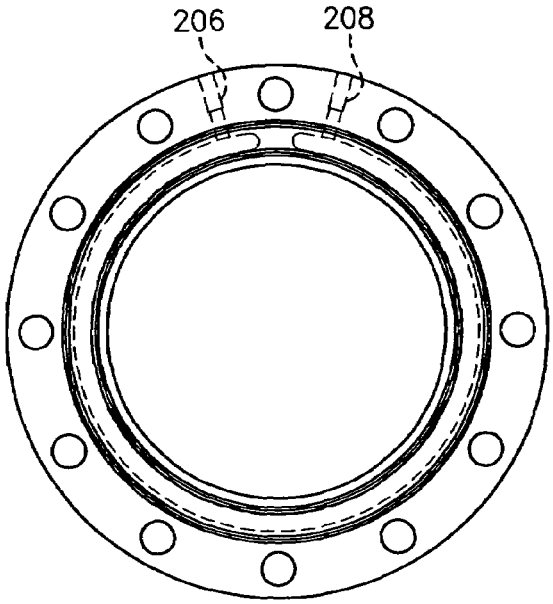
FIG. 9 is a downstream end view of a thermal isolation flange assembly.
Figure 12:
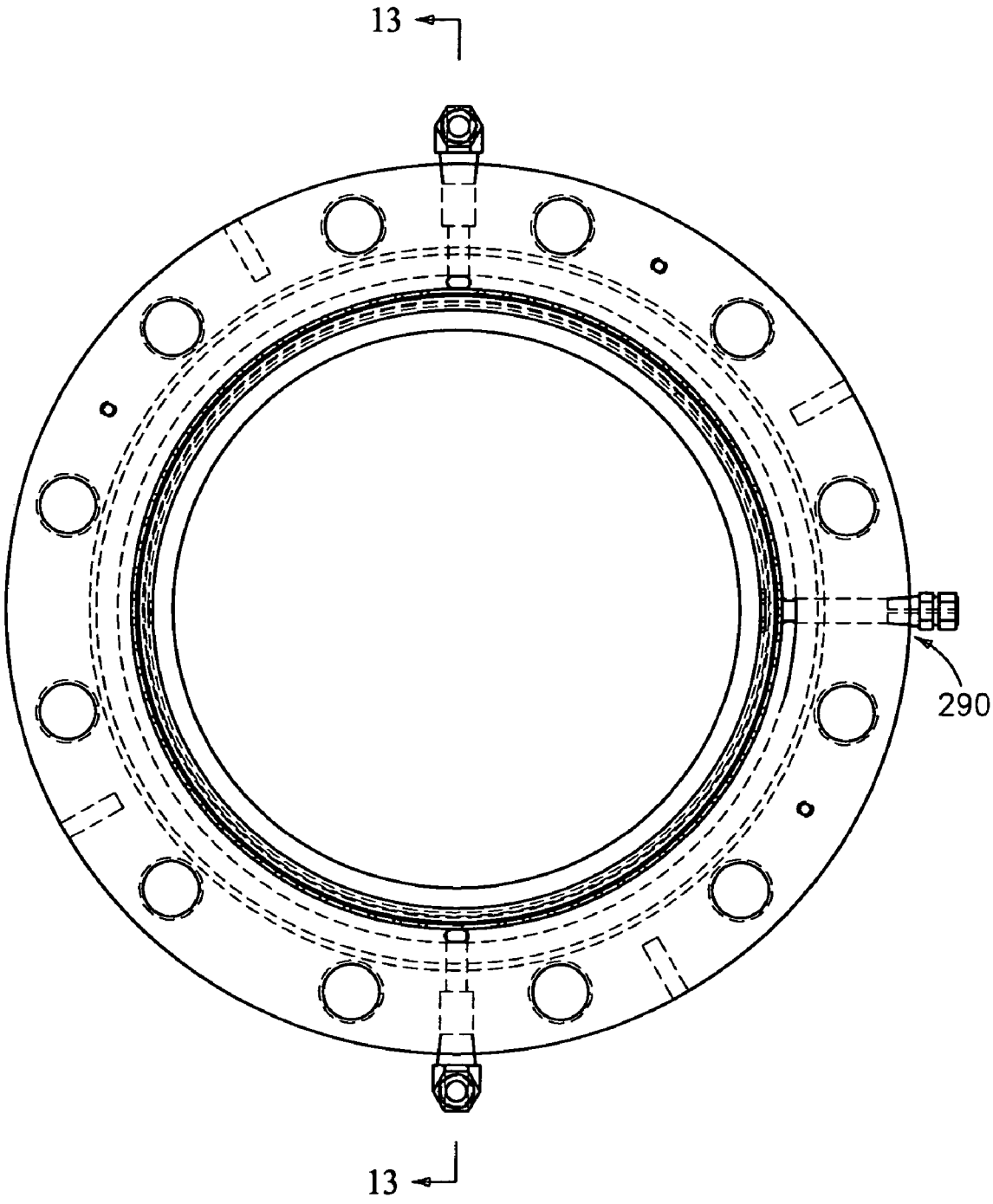
FIG. 12 is a downstream end view of a nozzle assembly of FIG. 11.

FIGS. 9 and 10 show details of the exemplary thermal isolation flange 152. The flange includes the upstream and downstream faces and an exterior perimeter surface 190. It further includes an interior surface 192 encircling the combustion gas flowpath at substantially even radius as the interior surfaces of the adjacent components. An array of bolt holes extend between the upstream and downstream faces. A channel 194 formed on one of the faces (e.g., the downstream face) extends longitudinally inward therefrom. In the illustrated embodiment, the channel has two general portions: a deep base portion 196 which is less than a full annulus; and a mouth portion 198 which extends to the associated face and is a full annulus. The mouth portion is wider than the base portion extending both radially outward and radially inward therefrom to define a pair of annular shoulder surfaces 200 and 202. In the exemplary embodiment, the channel is machined in two steps. The mouth portion may be machined and then the base portion may be machined below a base of the mouth portion, leaving a divider portion 204 of the flange between two ends of the base portion. Alternatively, the base portion may initially be formed as a full annulus and then a separate divider element inserted to turn the base channel into the partial annulus. A pair of passageways 206 and 208 connect the associated end portions of the channel base portion to associated exterior ports 210 and 212 (e.g., in the flange perimeter surface). The exterior ports may be equipped with appropriate fittings. In the exemplary embodiment, the mouth portion of the channel accommodates a full annulus sealing ring 214 which seats against the shoulder surfaces of the remaining body piece of the flange and may be welded in place to close the channel. Alternatively, in the absence of a mouth portion and sealing ring, the adjacent flange itself may close and seal the channel. In operation, a heat transfer fluid is introduced through one of the ports and withdrawn from the other after passing circumferentially through the channel. Exemplary heat transfer fluid may be liquid (e.g., aqueous (water or a water/glycol mixture) or oil-based) or gaseous (e.g., air or compressed/refrigerated $CO_2$ or $N_2$) as may be appropriate for desired heat transfer. Similarly, the heat transfer flowpath (e.g., channel) geometry and the flow rate may be tailored to achieve a desired heat transfer. The heat transfer fluid can both assist in cooling of the nozzle and in isolating elevated nozzle temperatures from upstream components. Such a thermal isolation flange may be used elsewhere in the system and may be used in other soot blower and different applications where thermal isolation is required. Materials and manufacturing techniques similar to those of the air curtain flange may be used.

Figure 13:
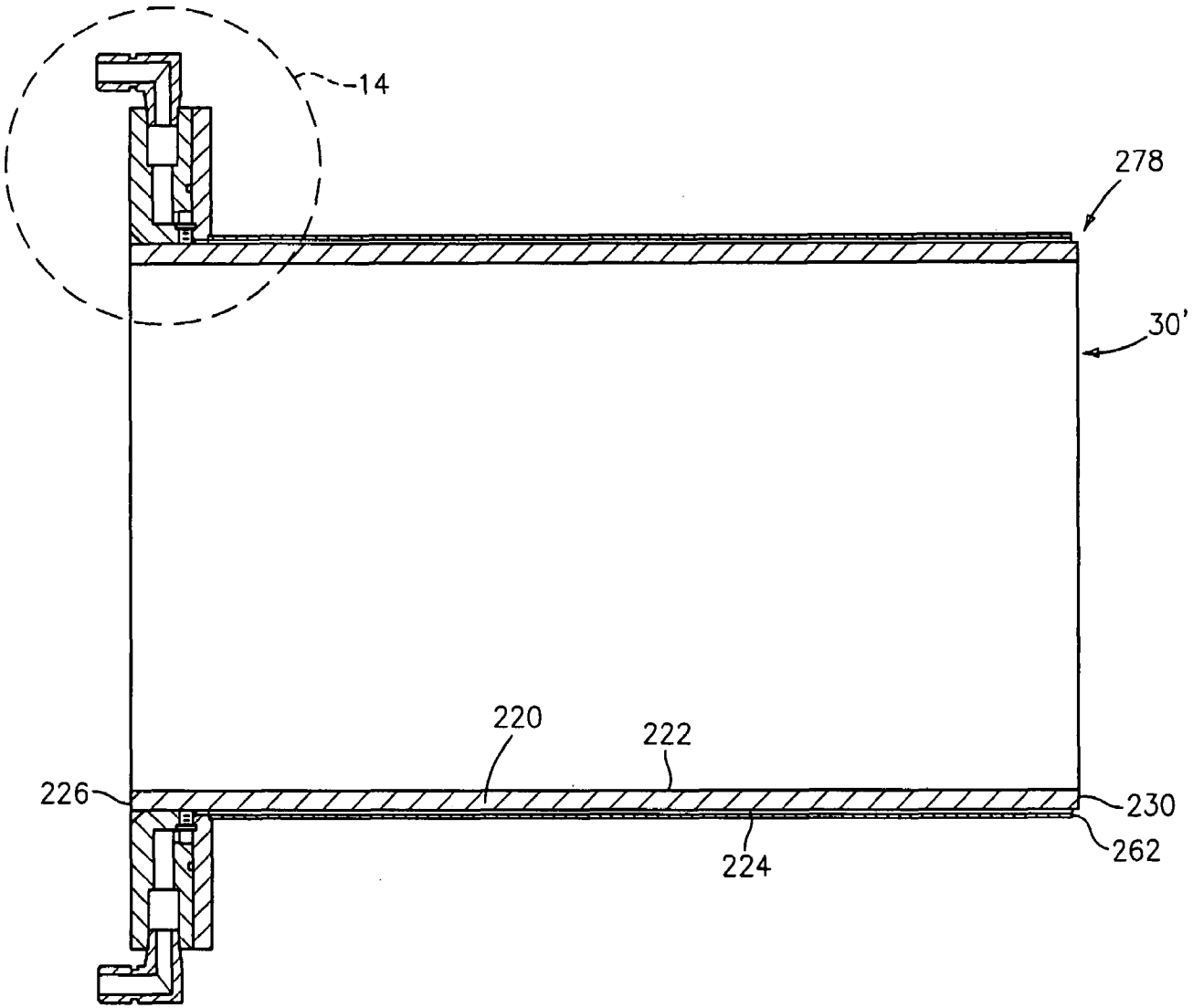
FIG. 13 is a longitudinal sectional view of the nozzle assembly of FIG. 12, taken along line 13—13.
Figure 14:
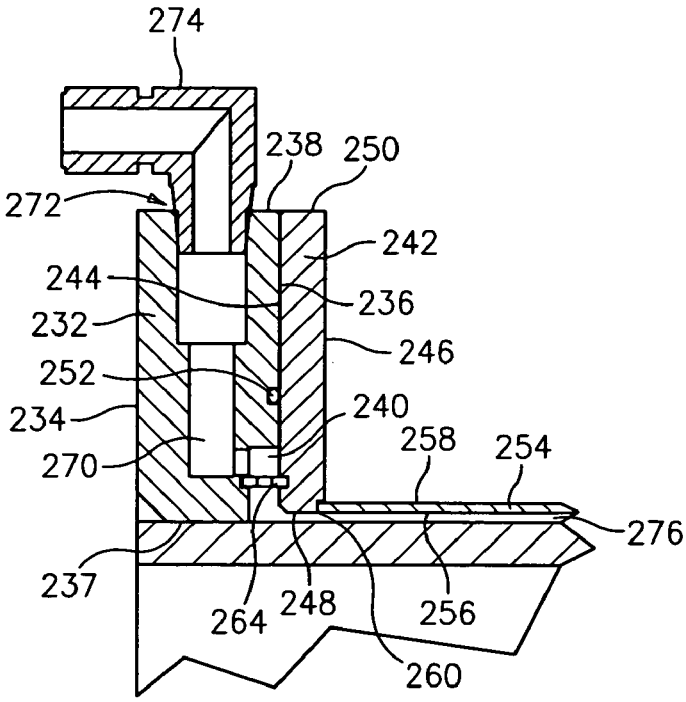
FIG. 14 is an enlarged view of a flange portion of the nozzle assembly of FIG. 13.

FIGS. 11–14 show further details of the nozzle assembly 156. FIG. 13 shows the nozzle assembly as including a main tube 220 having an interior surface 222 and an exterior surface 224 and extending from an upstream rim 226 to a downstream rim 230 essentially defining the outlet 30'. The interior surface may be at substantially even radius from the centerline as interior surfaces of other components described above. The flange 154 includes a main upstream piece 232 having upstream and downstream faces 234 and 236, an interior surface 237, and an exterior peripheral surface 238. The main piece 232 is secured to an upstream portion of the main tube 220 with its interior surface contacting the exterior surface of the tube. Exemplary connection is by welding. An annular plenum 240 may be machined in the main flange piece 232 (e.g., as a rebate of an inboard portion of the downstream face). An outboard portion of the channel is closed by the second flange piece 242 having upstream and downstream faces 244 and 246, an interior surface 248, and an exterior periphery 250. The upstream face 244 may abut the first piece downstream face 236 and be sealed thereto such as via an O-ring 252 residing at least partially in a channel in one or both of the pieces. The two pieces may be held together by the same bolts/nuts 160 or by separate bolts, welds, or the like. The interior surface 248 is spaced slightly apart from the tube exterior surface 224. A sleeve 254 has interior and exterior surfaces 256 and 258 and extends from an upstream end/rim 260 to a downstream end/rim 262 (FIG. 13). The interior surface 256 is similarly spaced apart from the tube exterior surface 224 and an upstream end portion is secured to the flange second piece (e.g., accommodated in an annular rebate and welded thereto). A metering ring 264 circumscribes the plenum 240 to separate radially inboard and outboard portions thereof and has a plurality of apertures therein. One or more feed passageways 270 (two shown) are in communication with the plenum 240. The passageways 270 are in communication with ports (e.g., in the flange first piece) 272 carrying fittings 274. A cooling fluid (e.g., a gas which may be similar to the air curtain gas) is introduced along a nozzle cooling flowpath downstream through the fittings, passageways, and into the outboard portion of the plenum 240. The ring 264 and its apertures meter the flow from the outboard portion of the plenum 240 to the inboard portion and help circumferentially distribute the flow when there are a relatively small number of discrete feed ports. From the inboard/downstream portion of the plenum 240, the flow proceeds downstream in generally annular space 276 between the sleeve 254 and tube 220. In the exemplary embodiment, the cooling gas flow is discharged from a cooling gas outlet 278 between the sleeve downstream rim 262 and the adjacent portion of the tube exterior surface 224. In the exemplary embodiment, the sleeve downstream rim is slightly recessed relative to the tube downstream rim so as to mitigate the influence of the detonation wave on the cooling gas flow and mitigate the effect of the wave on the potentially relatively thin and fragile sleeve.

Figure 11:
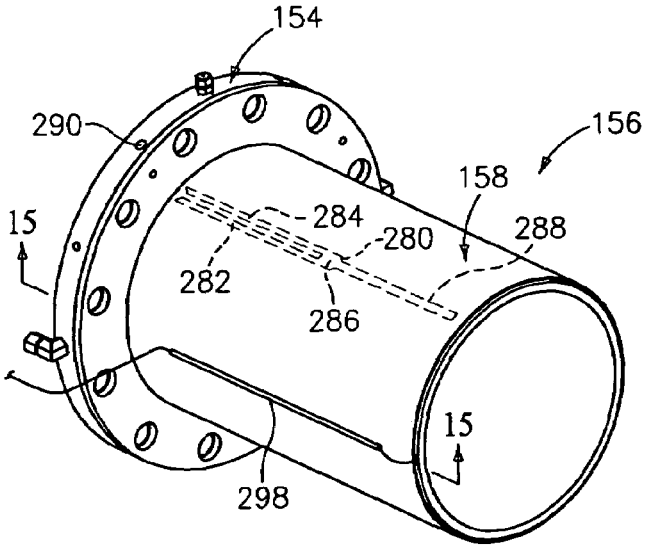
FIG. 11 is a view of a nozzle assembly.
Figure 15:
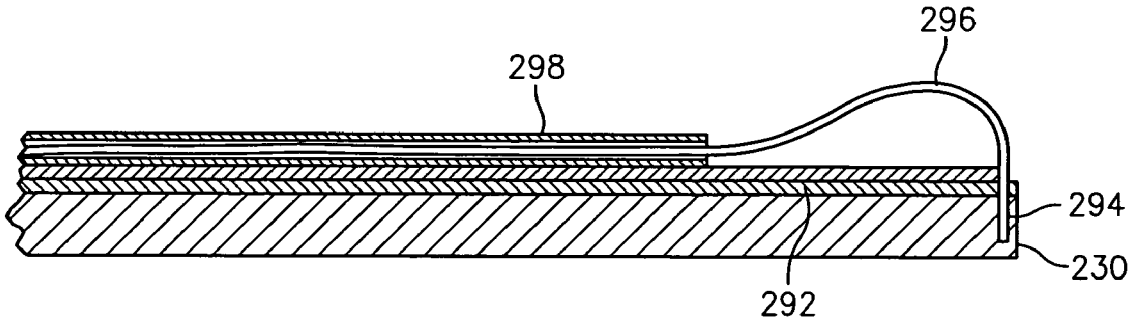
FIG. 15 is a partial longitudinal sectional view of a downstream end portion of the nozzle assembly of FIG. 11.

Advantageously, means are provided for maintaining the circumferentially spaced-apart relationship between the tube 220 and sleeve 254. Exemplary means include one or more spacer elements. The spacer elements may be associated with means for measuring temperature parameters of the nozzle body largely defined by the tube and sleeve downstream of the flange. FIG. 11 shows an exemplary first spacer 280. The exemplary first spacer is forked, having two tines 282 and 284 extending from upstream ends to a junction 286 from which a single leg 288 extends further downstream to a leg downstream end proximate the sleeve downstream end. The space between the tines may accommodate an additional thermocouple (not shown) adjacent the junction and with its wires running back upstream and passing through a thermocouple fitting port 290 in the main flange piece 232. FIG. 15 shows a second spacer 292 as an elongate, nominally rectangular, strip extending from an upstream end at the sleeve upstream end to a downstream end at the tube downstream end 230. The exemplary spacer 292 has, at its downstream end, an aperture between its outboard and inboard surfaces an aligned similar blind aperture extends inward from the tube exterior surface. A thermocouple 294 is mounted within the blind aperture and has its body 296 extending outward, around the sleeve, and through a protective tube 298 (also FIG. 11) secured to the exterior surface of the sleeve. The thermocouple 294 serves to measure temperatures at the tube downstream rim. Flange materials and mounting techniques may be similar to those of the air curtain and thermal isolation flanges. Tube, sleeve, and ring materials may be similar and may be made by a variety of known manufacturing techniques (e.g., rolling and welding of sheet stock or machining).

In operation, the control and monitoring system uses the first thermocouple 294 to principally monitor the temperature of the nozzle assembly portion exposed to the furnace interior. The aforementioned additional thermocouple may be monitored as a back-up in the event of a failure of the first thermocouple when it is not desirable to immediately initiate a shutdown for repair. The same or different critical temperatures may be utilized in determining shutdown based upon the outputs of the two thermocouples.

Returning to FIG. 6, the nozzle assembly may be provided with an interface plate 300 largely closing the portion of the furnace wall aperture outboard of the nozzle body. In operation, the plate 300 is normally positioned in close or contacting proximity to the furnace wall outer surface. The plate may have a number of apertures for accommodating various measuring, sampling, observation, and other equipment. These apertures may be provided with covers when not in use. A series of struts 302 connect the plate 300 to the flange 154 to hold the plate relative to the flange. The plate may have an aperture closely encircling the body 158. The plate normally blocks the wall aperture to at least partially restrict flow of gases and particles from between the combustion tube and wall aperture (e.g., inflow with a negative pressure furnace). Upon discharge of the apparatus, the exemplary plate recoils with the combustion conduit and is returned along therewith to its original place by the action of the reaction strap/spring combination. The exemplary plate material is steel or nickel- or cobalt-based superalloy, optionally provided with an insulating layer (e.g., cementaceous material).

One or more embodiments of the present invention have been described. Nevertheless, it will be understood that various modifications may be made without departing from the spirit and scope of the invention. For example, the invention may be adapted for use with a variety of industrial equipment and with variety of soot blower technologies. Aspects of the existing equipment and technologies may influence aspects of any particular implementation. Other shapes of combustion conduit (e.g., non-straight sections to navigate external or internal obstacles) may be possible. Accordingly, other embodiments are within the scope of the following claims.

What is claimed is:

1. An apparatus in combination with a flow of liquid, the apparatus comprising:

a body having:

first and second faces;

an inboard surface bounding a central aperture;

an outboard perimeter;

an array of bolt holes between the first and second faces;

a channel in the first face inboard of the bolt holes; and first and second ports in communication with the channel, the flow of liquid entering the body through the first port and flowing through the channel and exiting the body through the second port.

2. The combination of claim 1 wherein:

the first and second ports are formed in the perimeter.

3. The combination of claim 1 wherein:

there are at least 8 such bolt holes.

4. The combination of claim 1 wherein:
heat is exchanged from the apparatus to the liquid.

5. A method for using the apparatus of claim 1 comprising:
directing said flow of liquid to enter the first port and exit the second port so as to thermally isolate a first conduit section on the first side of the body from a second conduit section on a second side of the body.

6. The combination of claim 1 wherein the channel is between the inboard surface and the outboard perimeter.

7. A method for operating a detonative cleaning apparatus for cleaning a surface within a vessel, the method comprising:
repeatedly:
charging a conduit with a charge; and
detonating the charge, resulting in the direction of a shockwave from an outlet portion of the conduit to impact the surface; and
locally cooling a portion of the conduit upstream of the outlet portion.

8. The method of claim 7 wherein:
the cooling is provided via a cooling fluid;
the cooling is provided at no less than 0.1 m upstream of an outlet end of the conduit and at no less than 2 m downstream of an upstream end of the conduit; and
the cooling fluid has an essentially constant flow between discharges of the apparatus.

9. The method of claim 7 wherein:
the cooling is provided via a cooling fluid; and
the cooling fluid flows along a flowpath nonintersecting with a conduit discharge flowpath.

10. An apparatus comprising:
a body having:
first and second faces;
an inboard surface bounding a central aperture;
an outboard perimeter;
an array of bolt holes between the first and second faces;
a channel inboard of the bolt holes; and
first and second ports in communication with the channel;
a first conduit having a first flange having an array of bolt holes;
a second conduit having a second flange having an array of bolt holes; and
an array of bolts, each of the bolts extending through:
an associated one of the bolt holes of the fist flange:
an associated one of the bolt holes of the second flange; and
an associated one of the bolt holes of the body.

11. The apparatus of claim 10 in further combination with a flow of an aqueous liquid through the channel and entering the body through the first port and exiting the body through the second port.

12. An apparatus comprising:
a unitary metal body having:
first and second faces;
an inboard surface bounding a central aperture;
an outboard perimeter;
an array of bolt holes between the first and second faces;
a channel inboard of the bolt holes and having:
a fill annulus outboard portion; and
a partial annulus second portion of at least 300° of arc; and
first and second ports in communication with the channel.

13. The apparatus of claim 12 wherein:
the channel is in the first face.

14. The apparatus of claim 13 further comprising:
a sealing ring residing in an outboard portion of the channel.

15. The apparatus of claim 12 wherein:
the first and second ports are formed in the perimeter.

16. An apparatus comprising:
a body having:
first and second faces;
a radially inboard surface bounding a central aperture;
a radially outboard perimeter;
an array of bolt holes between the first and second faces;
a channel radially inboard of the bolt holes; and
first and second ports formed in the perimeter and in communication with the channel, the channel radially inboard of the first and second ports.

17. An apparatus comprising:
a unitary metal body having:
first and second faces;
an inboard surface bounding a central aperture;
an outboard perimeter;
an array of bolt holes between the first and second faces;
a full annulus channel inboard of the bolt holes; and
first and second ports in communication with the channel; and
a divider member, not unitarily formed with the body, is positioned in the channel between the first and second ports.

18. An apparatus comprising:
a body having:
first and second faces;
an inboard surface bounding a central aperture;
an outboard perimeter;
an array of bolt holes between the first and second faces;
a channel inboard of the bolt holes; and
first and second ports in communication with the channel;
a furnace having a furnace wall separating a furnace exterior from a furnace interior and having a wall aperture;
a soot blower outlet assembly positioned to direct a soot blower gas flow through the wall aperture;
a soot blower gas source; and
one or more soot blower gas conduit portions along a soot blower gas flowpath between the soot blower gas source and the soot blower outlet assembly, the body also being positioned along the soot blower gas flowpath.

19. An apparatus comprising:
a body having:
first and second faces;
an inboard surface bounding a central aperture;
an outboard perimeter;
an array of bolt holes between the first and second faces;
a channel inboard of the bolt holes; and
first and second ports in communication with the channel and not in the inboard surface; and
a flow of a liquid entering the first port and exiting the second port and cooling the body.

20. An apparatus in combination with a vessel, wherein:
the vessel has vessel wall separating a vessel exterior from a vessel interior and having a wall aperture; and the apparatus comprises:
a body having:
first and second faces;
an inboard surface bounding a central aperture;
an outboard perimeter;
an array of bolt holes between the first and second faces;
a channel inboard of the bolt holes; and
first and second ports in communication with the channel;
an outlet assembly positioned to direct a gas flow through the wall aperture;
a gas source; and
one or more gas conduit portions along a gas flowpath between the gas source and the outlet assembly, the apparatus also being positioned along the gas flowpath.

21. The combination of claim 20 wherein:
the channel is in the first face.

22. The combination of claim 20 wherein:
the vessel is a furnace.

23. The combination of claim 20 wherein:
the outlet assembly extends at least partially through the vessel wall.

24. An apparatus comprising:
a body having:
first and second faces;
an inboard surface bounding a central aperture;
an outboard perimeter;
an array of bolt holes between the first and second faces;
a channel in the first face inboard of the bolt holes; and
first and second ports in communication with the channel; and
a sealing ring residing in an outboard portion of the channel.

25. An apparatus comprising:
a body being a unitary metal member and having:
first and second faces;
an inboard surface bounding a central aperture;
an outboard perimeter;
an array of bolt holes between the first and second faces;
a full annulus channel in the first face inboard of the bolt holes; and
first and second ports in communication with the channel; and
a divider member positioned in the channel between the first and second ports.

26. An apparatus comprising:
a body being a unitary metal member and having:
first and second faces;
an inboard surface bounding a central aperture;
an outboard perimeter;
an array of bolt holes between the first and second faces;
a channel in the first face inboard of the bolt holes and having:
a full annulus outboard portion; and
a partial annulus second portion of at least 300° of arc; and
first and second ports in communication with the channel.

27. An apparatus comprising:
a body having:
first and second faces;
an inboard surface bounding a central aperture;
an outboard perimeter;
an array of bolt holes between the first and second faces;
a channel in the first face inboard of the bolt holes; and
first and second ports in communication with the channel;
a mating flange having a first face in facing relation to the first face of the body; and
a plurality of bolts, each of which extends through an associated one of the bolt holes.

* * * * *

UNITED STATES PATENT AND TRADEMARK OFFICE

CERTIFICATE OF CORRECTION

PATENT NO. : 7,047,908 B2
APPLICATION NO. : 10/733510
DATED : May 23, 2006
INVENTOR(S) : Raymond N. Henderson It is certified that error appears in the above-identified patent and that said Letters Patent is hereby corrected as shown below:

In column 11, claim 10, line 47, “fist” should read --first--.

In column 11, claim 12, line 63, “fill” should read --full--.

Signed and Sealed this

Tenth Day of April, 2007

JON W. DUDAS
*Director of the United States Patent and Trademark Office*